US008087337B1

(12) United States Patent
Cary

(10) Patent No.: US 8,087,337 B1
(45) Date of Patent: Jan. 3, 2012

(54) RECOIL COMPENSATION AND CLIMB ARRESTER

(76) Inventor: William R. Cary, Springfield, MO (US)

( * ) Notice: Subject to any disclaimer, the term of this patent is extended or adjusted under 35 U.S.C. 154(b) by 0 days.

(21) Appl. No.: 12/800,625

(22) Filed: May 19, 2010

Related U.S. Application Data

(63) Continuation of application No. 12/660,754, filed on Mar. 3, 2010, now abandoned.

(60) Provisional application No. 61/209,067, filed on Mar. 3, 2009, provisional application No. 61/276,874, filed on Sep. 17, 2009.

(51) Int. Cl.
*F41A 21/00* (2006.01)

(52) U.S. Cl. ..... 89/14.3

(58) Field of Classification Search ..... 89/14.3
See application file for complete search history.

(56) References Cited

U.S. PATENT DOCUMENTS

| | | | | | |
|---|---|---|---|---|---|
| 785,972 | A | * | 3/1905 | McClean | 89/14.3 |
| 785,974 | A | * | 3/1905 | McClean | 89/193 |
| 786,230 | A | * | 3/1905 | McClean | 89/14.3 |
| 817,134 | A | * | 4/1906 | Smith | 89/14.3 |
| 1,427,802 | A | | 9/1922 | Goodwin | 89/14.3 |
| 1,450,558 | A | * | 4/1923 | Maze dit Delamare-Maze | 89/1.1 |
| 1,854,974 | A | * | 4/1932 | Bernat | 181/223 |
| 1,948,496 | A | * | 2/1934 | Barnes | 89/14.3 |
| 2,402,632 | A | | 6/1946 | Ivanovic | 89/14.3 |
| 2,499,428 | A | | 3/1950 | Tiffany | 89/14.3 |
| 2,899,866 | A | * | 8/1959 | Clark et al. | 89/37.16 |
| 3,114,289 | A | | 12/1963 | Aulabaugh | 89/14.3 |
| 3,141,376 | A | * | 7/1964 | Chinn | 89/14.3 |
| 3,492,912 | A | | 2/1970 | Ashbrook | 89/14.3 |
| 3,707,899 | A | | 1/1973 | Perrine | 89/14.3 |
| 5,020,416 | A | | 6/1991 | Tripp | 89/14.3 |
| 5,036,747 | A | * | 8/1991 | McClain, III | 89/14.3 |
| 5,357,842 | A | * | 10/1994 | Reynolds | 89/14.3 |
| 6,425,310 | B1 | * | 7/2002 | Champion | 89/14.3 |
| 6,595,099 | B1 | | 7/2003 | Olson et al. | 89/14.3 |
| 7,073,426 | B1 | | 7/2006 | White | 89/14.4 |
| 7,143,680 | B2 | * | 12/2006 | Bender | 89/14.3 |
| 7,600,461 | B1 | * | 10/2009 | Cler et al. | 89/14.3 |
| 7,856,914 | B2 | * | 12/2010 | Shults et al. | 89/14.4 |
| 2002/0112602 | A1 | * | 8/2002 | Champion | 89/14.3 |
| 2003/0154849 | A1 | * | 8/2003 | Breuer | 89/14.3 |

(Continued)

OTHER PUBLICATIONS

Brownells® guns parts catalog, © 2004, pp. 52-55, Compensators and Brakes.
MidwayUSA guns parts catalog, © 2006, pp. 539-540.

*Primary Examiner* — Stephen M Johnson
*Assistant Examiner* — Samir Abdosh
(74) *Attorney, Agent, or Firm* — Jonathan A. Bay

(57) ABSTRACT

A recoil compensator and climb arrester has an axially-elongated hollow sidewall having an inner surface. Three apertured baffles with central apertures are fixed inside the sidewall spaced apart from one another to define three longitudinally-distributed gas-expansion chambers. Each baffle has a convex rear surface which meets the sidewall in a circular crease. Each chamber has one top port through the sidewall as well as a pair of opposite side ports. Each port has a one edge, a sill, which is closest to the crease. The distance between the sill and the crease defining a knee wall. Wherein, the expansion of the gases of a muzzle blast in the expansion chambers deflect in part off convex rear surfaces of the baffles and get checked in part by the knee-wall portions of each port ensuing the exhausting of the gases through ports across the sills thereof.

7 Claims, 7 Drawing Sheets

U.S. PATENT DOCUMENTS

| | | | | |
|---|---|---|---|---|
| 2004/0244571 | A1* | 12/2004 | Bender | 89/14.3 |
| 2006/0123983 | A1* | 6/2006 | Vais | 89/14.3 |
| 2007/0095198 | A1 | 5/2007 | Dater et al. | 89/14.3 |
| 2007/0107590 | A1 | 5/2007 | Silvers | 89/14.4 |
| 2007/0266844 | A1 | 11/2007 | Dueck | 89/14.4 |
| 2010/0224054 | A1* | 9/2010 | Langner | 89/14.3 |

* cited by examiner

RECOIL COMPENSATION AND CLIMB ARRESTER

CROSS-REFERENCE TO RELATED APPLICATION(S)

This application is a continuation of U.S. patent application Ser. No. 12/660,754, filed Mar. 3, 2010, now abandoned which claims the benefit of U.S. Provisional Application No. 61/209,067, filed Mar. 3, 2009, and U.S. Provisional Application No. 61/276,874, filed Sep. 17, 2009. The foregoing patent disclosures are incorporated herein by this reference thereto.

BACKGROUND AND SUMMARY OF THE INVENTION

The invention generally relates to firearms and, more particularly, to gun silencers, recoil absorbers, and climb arresters.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

The foregoing drawings are drawn to scale, albeit on an enlarged scale that is likely in excess of double original size.

DETAILED DESCRIPTION OF THE PREFERRED EMBODIMENTS

The drawings show a recoil compensator and climb arrester 10 in accordance with the invention, hereinafter "compensator" for sake of brevity. As a matter of non-limiting background, the preferred embodiment shown by the drawings has been developed, tested, refined (and so on) through several cycles of refinement in connection with an M4 or M16 firearm (not shown).

Figure 1:
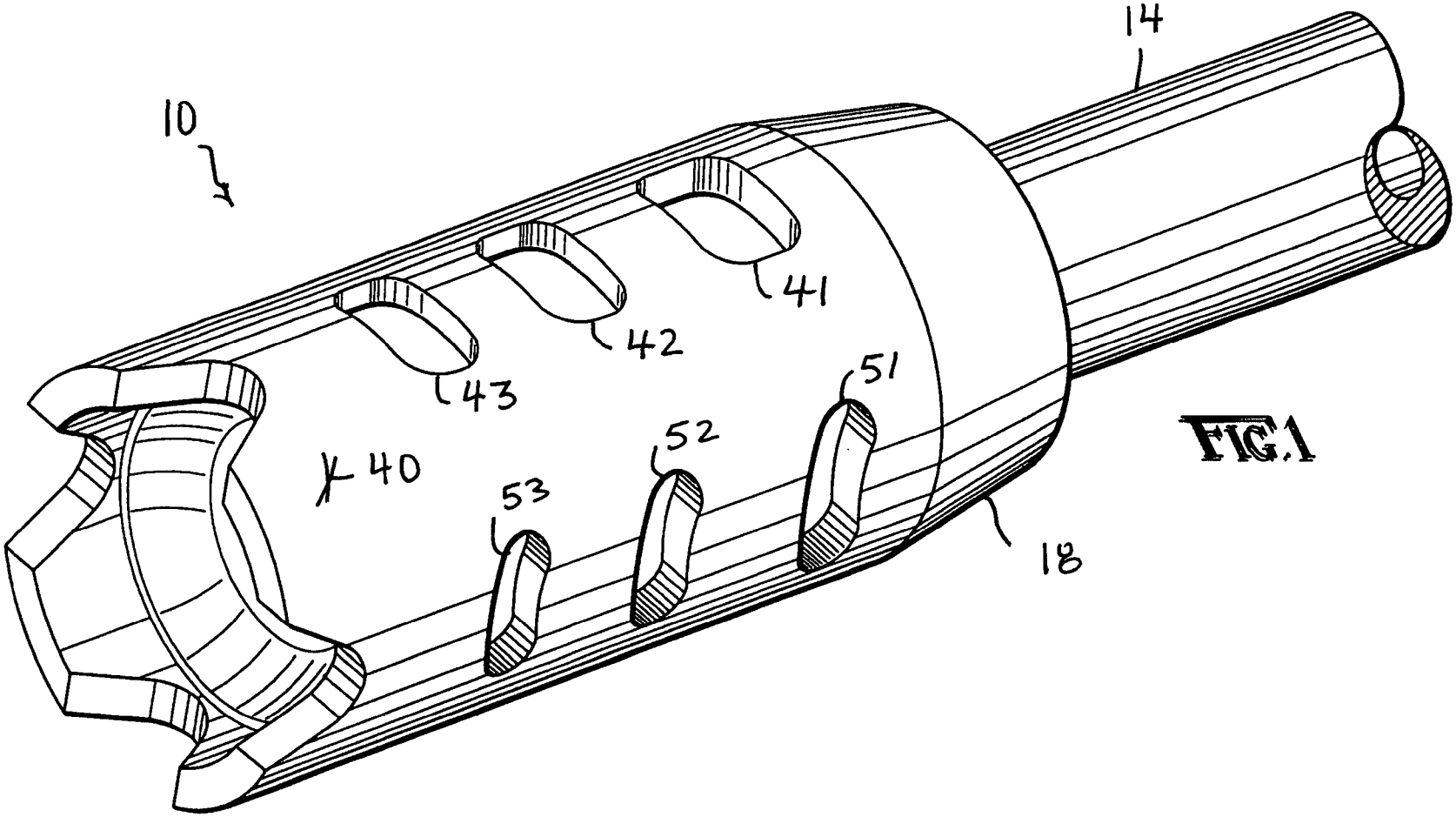
FIG. 1 is a perspective view of a recoil compensator and climb arrester in accordance with the invention.
Figure 2:
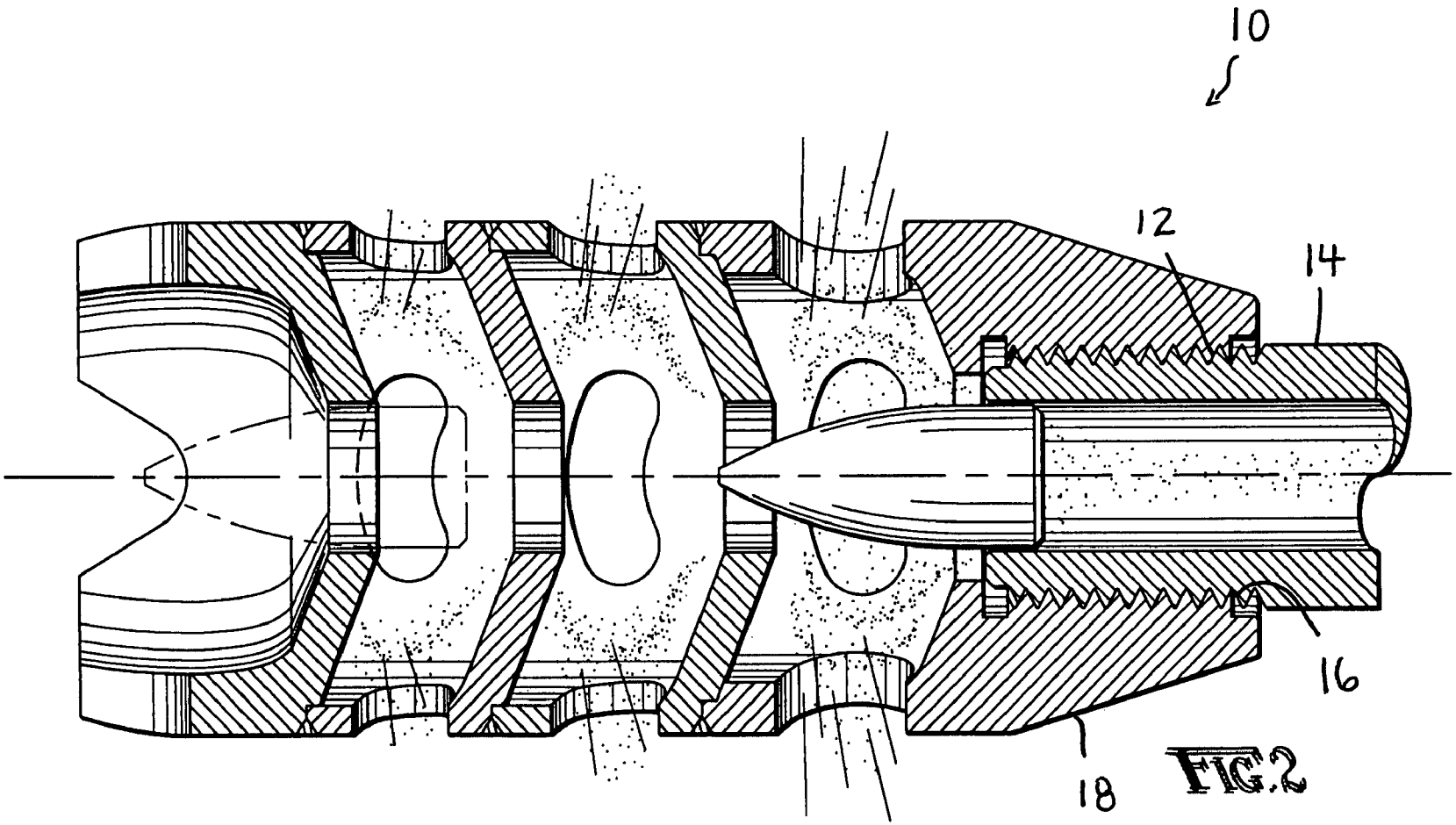
FIG. 2 is a bottom plan, axial sectional view thereof taken through a horizontal plane of symmetry wherein, for the purpose of illustrating a typical use environment, a muzzle of a gun barrel is shown as well as a bullet in transit through the first expansion chamber and just at the threshold of entering the second.
Figure 3:
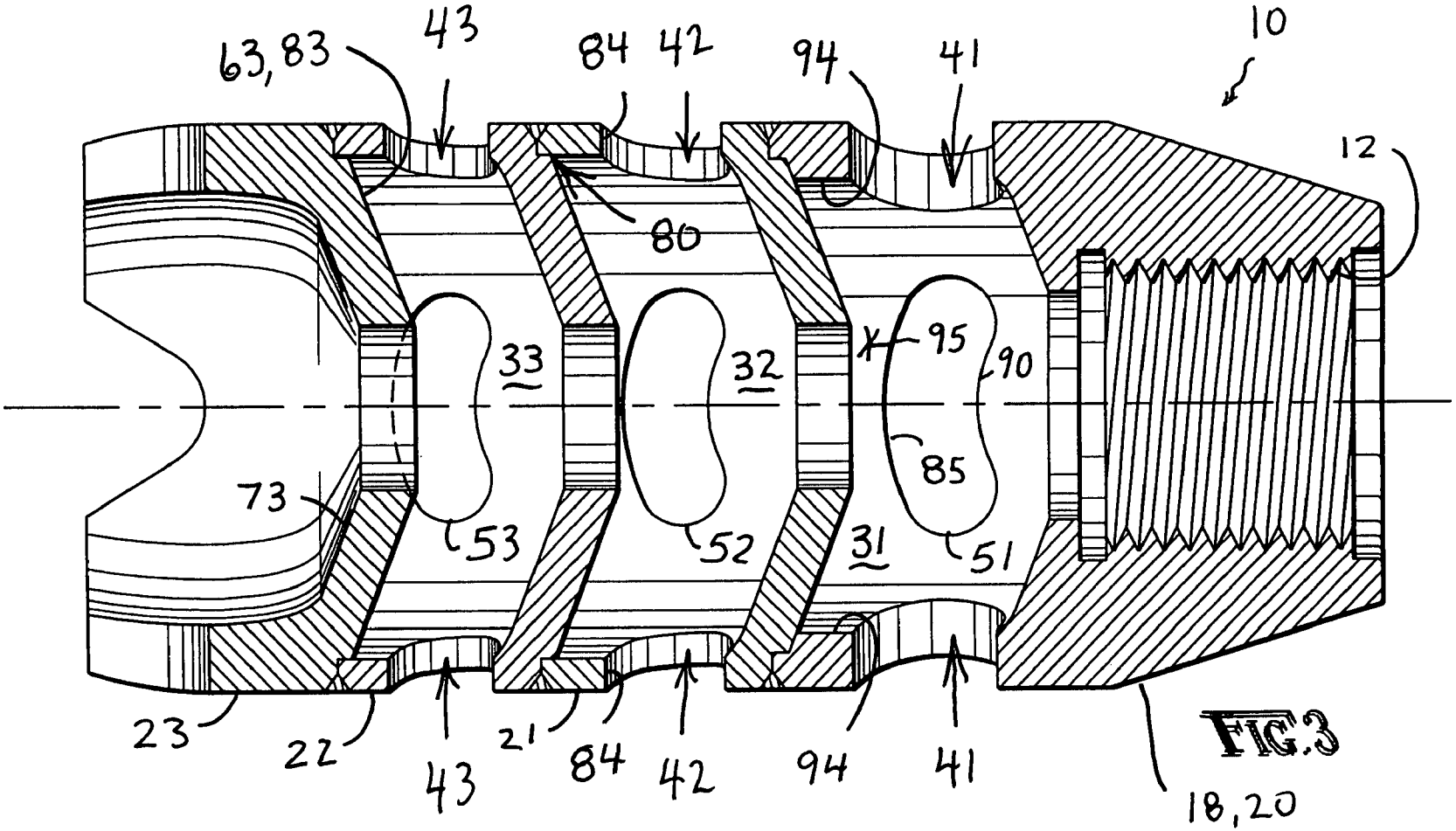
FIG. 3 is a bottom plan, axial sectional view comparable to FIG. 2 except on an enlarged scale and with the bullet as well as the muzzle of the gun barrel removed.
Figure 4:
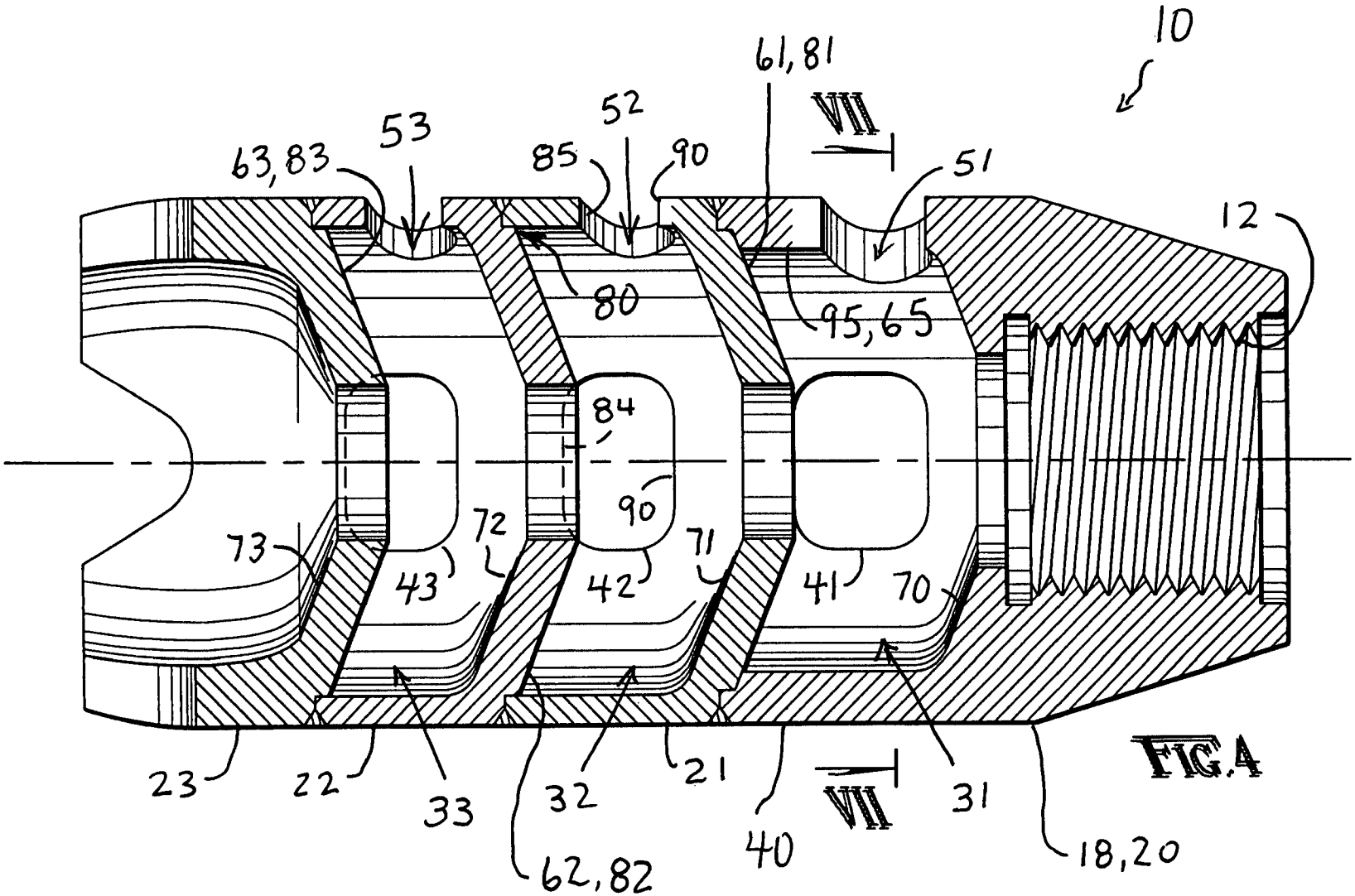
FIG. 4 is a side elevational, axial sectional view thereof taken through a vertical plane of symmetry.
Figure 5:
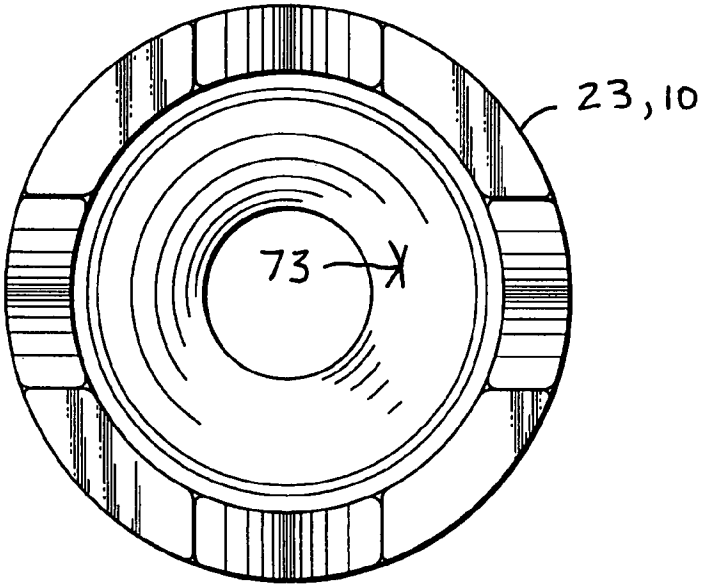
FIG. 5 is a front elevational view thereof.
Figure 6:
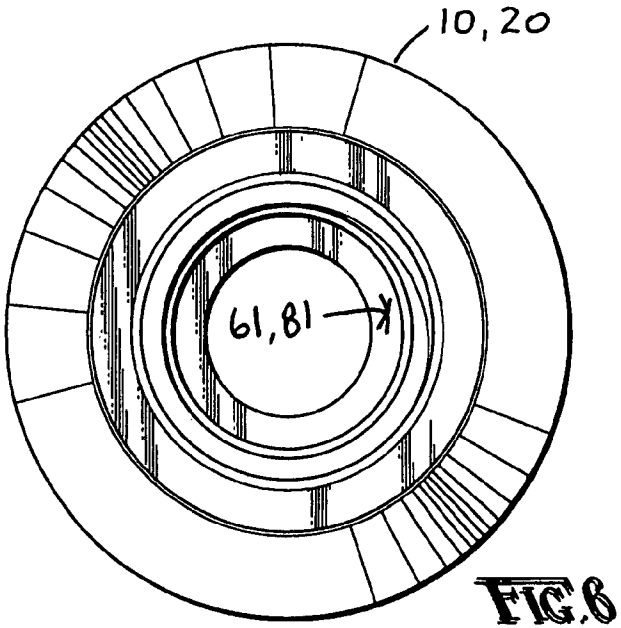
FIG. 6 is a rear elevational view thereof.
Figure 7:
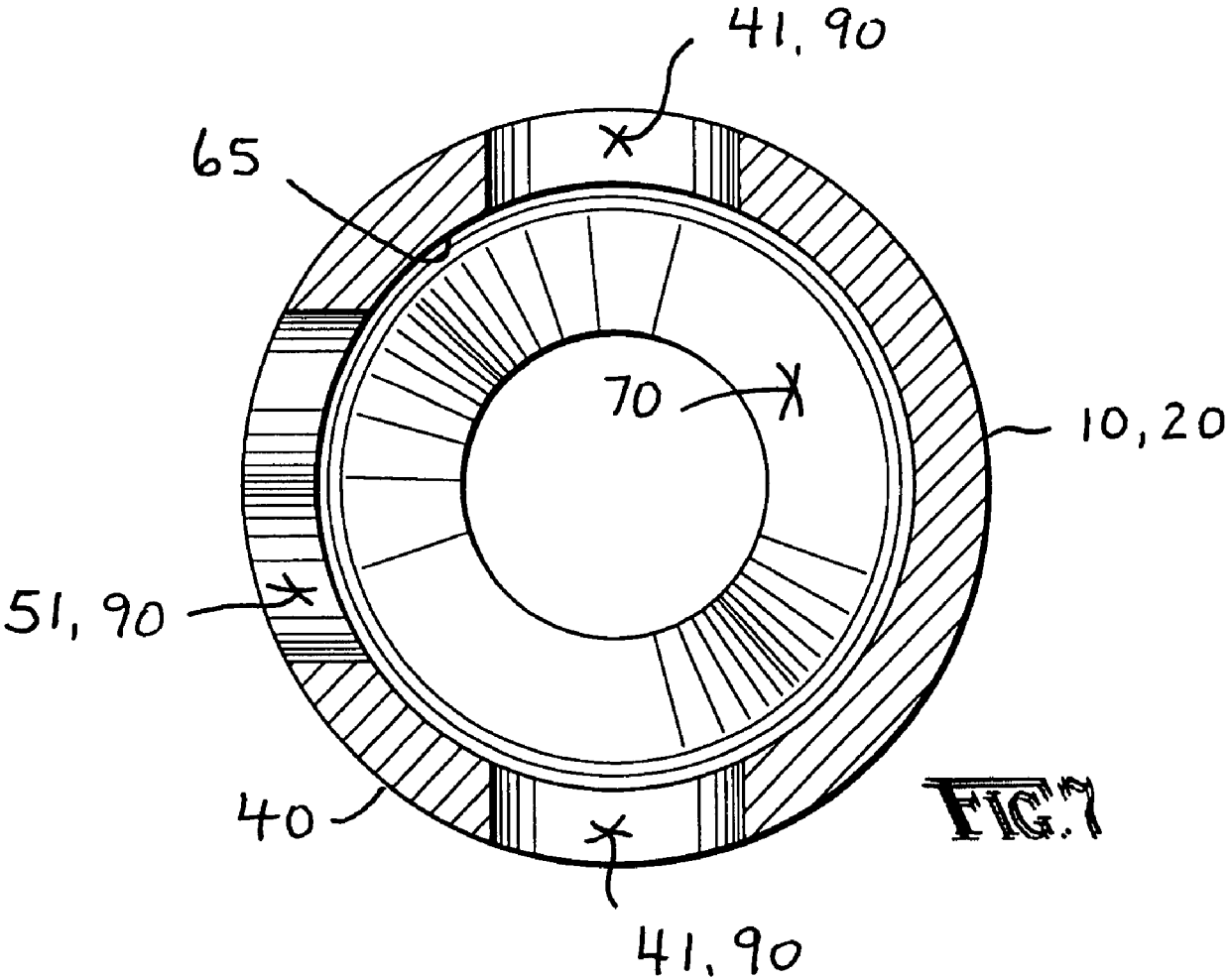
FIG. 7 is a sectional view taken through line VII-VII in FIG. 4.

The compensator 10 has a rear end provided with muzzle interface provisions 12 (eg., such as internal thread, and not shown) to couple onto the end of the muzzle 14 of a gun barrel. The gun barrel's muzzle 14 is likewise provided with external thread 16, and the compensator 10 is twisted onto the muzzle's threaded end 16 as better shown in FIG. 2.

For the compensator 10, preferred construction materials include without limitation stainless steel or titanium (or an alloy thereof). However, it might be preferred to select a metal that would minimize the effects of a galvanic cell concerning the gun barrel muzzle 14.

The compensator 10 comprises a chain or assemblage 18 of four cylindrical plugs 20-23 welded together. Defined between adjacent plugs 20-23 are a series of three vented chambers 31-33. The four plugs 20-23 thus welded together present a monolithic cylindrical sidewall 40 that is, however, apertured through with sets of venting ports 41-43 and 51-53 for each vented chamber 31-33. The ports 41-43 and 51-53 aside, the compensator 10 is substantially constructed on radial coordinates, and is symmetric about the central axis.

The second, third and fourth plug 21-23 all present a tapered conical baffle portion 61-63, respectively, formed with the central bore (bullet orifice). The tapered conic shapes 61-63 provide not only reverse deflection but also radial deflection to the sidewall 40. Each vented chamber 31-33 has left and right side venting ports 41-43, respectively, and a top venting port 51-53, respectively. Hence, it is also accurate to say that, the tapered conic shapes 61-63 provide not only reverse deflection but also radial deflection to venting ports 41-43 and 51-53 in the sidewall 40. All nine venting ports 41-43 and 51-53 provide service as recoil absorbers. The three top venting port 51-53 also provide service as climb arresters. The six side venting ports 41-43 have a quadrilateral shape with rounded corners. The three top venting ports 51-53 have a block-C shape with rounded ends.

More particularly, recoil compensator and climb arrester 20 in accordance with the invention (ie, "compensator" 20) comprises the following. It has an axially-elongated hollow casing 18 having a sidewall 40 having an inner surface 65 defining an interior duct.

Figure 8:
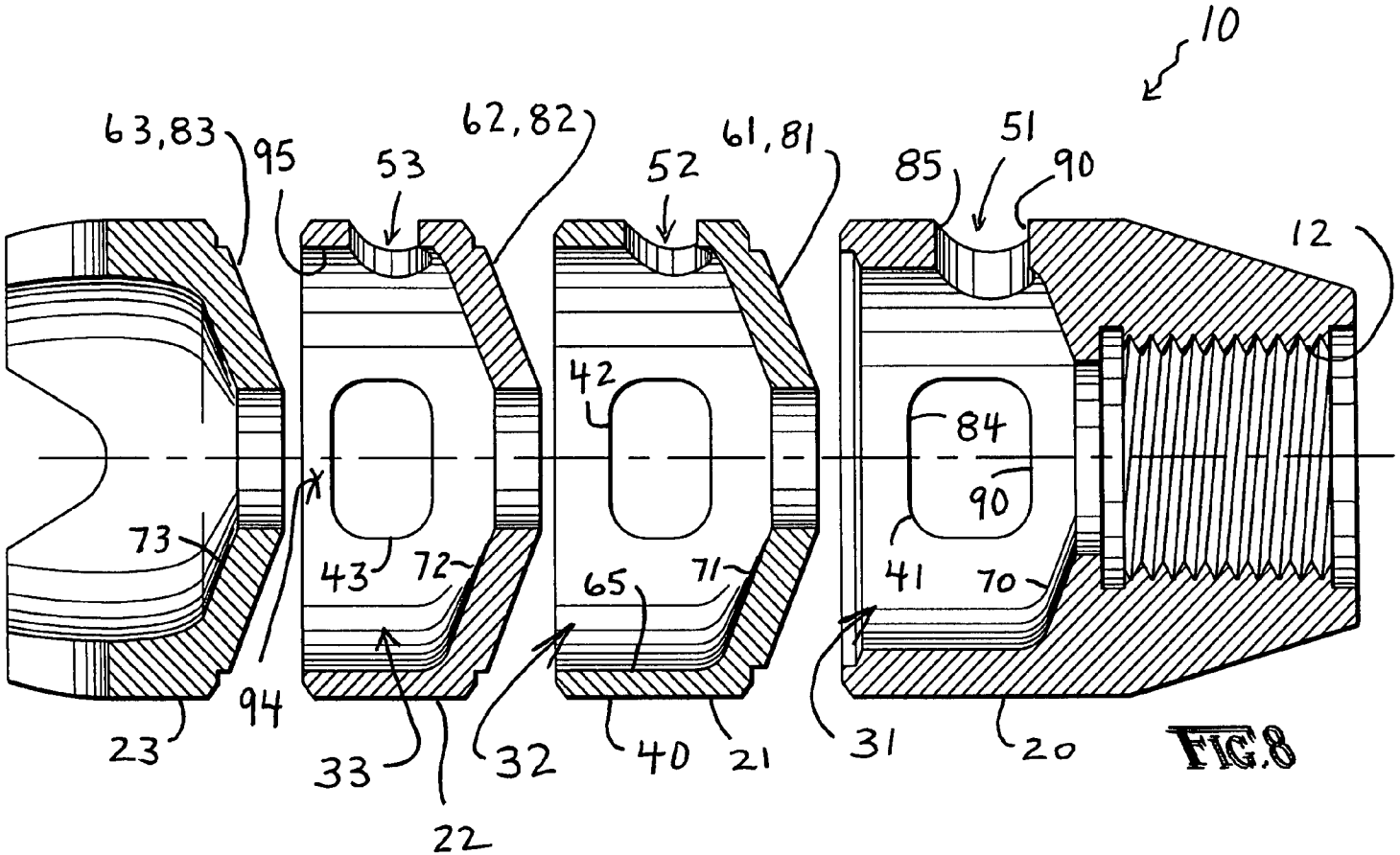
FIG. 8 is a side elevational, axial sectional view taken through a vertical plane of symmetry and comparable to FIG. 4, except showing the welded assemblage of modular plugs.

As FIG. 8 shows better, the casing 18 comprises an assemblage of at least four plugs 20-23 linked end-to-end to define at least three expansion chambers 31-33. The first plug 20 in the series, starting at the rear end, is formed with the muzzle-engaging formations 12 at the rear end. The first plug 20 also has a concave front surface 70 which fords itself in the (rear of the) first chamber 31, as well as provides the sidewall 40 for that much of just the first chamber 31.

The second plug 21 provides the first baffle 61. The first baffle 61 is apertured and has a convex rear surface 81 that finds itself in the (front of the) the first chamber 31 and a concave front surface 71 that finds itself in the (rear of the) the second chamber 32. The second plug 21 also provides the sidewall 40 for that much of the second chamber 32.

The third plug 22 correspondingly provides the second baffle 62. The second baffle 62 is apertured and has a convex rear surface 82 that finds itself in the (front of the) the second chamber 32 and a concave front surface 72 that finds itself in the (rear of the) the third chamber 33. The third plug 22 also provides the sidewall 40 for that much of the third chamber 33.

The fourth plug 23 provides the third baffle 63. The third baffle 63 is apertured and has a convex rear surface 83 that finds itself in the (front of the) the third chamber 33. The third baffle 63 has a concave front surface 73. The fourth plug 23 further includes wire-cutter formations beyond the third baffle 63's concave front surface 73.

Again, preferably the plugs 20-23 are stainless steel or titanium or titanium alloy which accepts welding such that the plugs 20-23 are welded into a monolithic unit 18.

Hence the plurality of baffles 61-63 have central apertures. They are fixed inside the duct longitudinally spaced apart from one another to partition the duct of the casing 18 into a plurality of longitudinally-distributed gas-expansion chambers 31-33.

The plurality of baffles 61-63 are aligned such that the central apertures thereof define a central bore which is coaxial with the bore of the gun barrel 14. Each baffle 61-63 has a convex rear surface 81-83, respectively, for deflection of gases. Each convex rear surface 81-83 meets the sidewall 40's inner surface 65 in a circular crease 80.

The sidewall 40 being formed with at least three ports 41, 41 and 51; 42, 42 and 52; and 43, 43 and 53 per respective expansion chamber 31-33, respectively, for the exhaustion of gases. These ports 41-43 and 51-53 comprise at least one top port 51-53 as well as a pair of opposite side ports 41-43. Each port 41-43 and 51-53 is angularly elongated in the sidewall 40 between angularly spaced closed-ends spacing a sill 84 or 85 from a rearwardly-spaced brow 90.

The sidewall 40 is characterized with at least three knee-wall portions 94, 94 and 95 per chamber 31-33. Each knee-wall portion 94 or 95 is defined on the sidewall 40 as the axially-extending portion between the sill 84 or 85 of the respective port 41-43 or 51-53, respectively, and the axially forward crease 80.

That way, the expansion of the gases of a muzzle blast in the expansion chambers 31-33 deflect in part off convex rear surfaces 81-83 of the baffles 61-63, and get checked in part by the knee-wall portions 94 or 95 of each port 41-43 or 51-53 ensuing the exhaustion of gases through ports 41-43 and 51-53 across the sills 84 and 85 thereof.

Preferably the convex rear surfaces 81-83 of the baffles 61-63 are, more particularly, conical.

It is an aspect of the invention that the exhaust ports 41-43 and 51-53 are formed in the sidewall 40 by turning tools that turn on turning axes substantially non-parallel to the central bore. It is an alternate aspect of the invention that the exhaust ports 41-43 and 51-53 are formed in the sidewall by turning tools that turn on turning axes perpendicular to the central bore. Put differently, the ports 41-43 and 51-53 are formed by drill presses, or milling machines, or water jets that are aligned on axes substantially non-parallel to the central bore.

In contrast, the surfaces 71-73 and 81-83 of the baffles 61-63 as well as the inner surface 65 of the sidewall 40 are formed out of stock material by turning tools that turn on turning axes, or else turning the stock material on a turning axis, which are substantially parallel or coaxial with the central bore. Put differently, these surfaces 71-73, 81-83 and 65 are formed by turning the part on a lathe or clamping the part and feeding it into a turning cutting tool or abrading tool.

So again, the compensator 10 comprises a series of expansion chambers 31-33 that are partitioned apart from one another and from the gun muzzle 14's bullet discharge end 16 by a series of internal baffles 61-63. The internal baffles 61-63 generally comprises a series of conical rings located inside the casing 18 of the compensator 10. The baffle profiles are obtained by turning on a lathe. The baffles 61-63 each have a convex rear surface 81-83 which, in each case, forms the front 'gas-deflecting' wall of the associated expansion chamber 31-33.

When the gas of a muzzle blast travels through the compensator 10, it expands in an expansion chamber 31, 32 or 33; deflects in part off the convex rear surfaces 81-83 of the baffles 61-63 into the sidewall 40, including getting checked in part by the knee wall portions 94 or 95 forward of each port 41-43 or 51-53. Then the expanded gases then overspill the sill 84 or 85 of the ports 41-43 or 51-53 to atmosphere.

The proportions of the sill expanse 84 or 85 to knee wall expanse 94 or 95, respectively, are critical to the effectiveness of the compensator 10.

When the inventor began creating this design, he did so by building proto-types, testing, and then re-designing in light of the test results. His process unfolded something as follows. He started with a tubular casing 18 as shown by the drawings, and with conic baffles 61-63 as also shown by the drawings. But he started with sizing and arranging the top ports 51-53 in isolation at first, without the side ports 41-43.

He chose the diameter of the chambers 31-33 (and the initial lengths) more or less on arbitrary reasons, perhaps patterning his compensator 10 after so many other compensators which sort of arrived on this diameter as matter of accepted wisdom at this point in history.

But again, then the inventor hereof went to work on the size and arrangement of the ports 51-53 as well as 41-43. Early on the inventor discounted any further work with circular ports and went with quadrilateral ports. Indeed, the final configuration of the top ports 51-53 are elongated slots with semicircular ends. However, they are not straight slots but, square-C shaped. However, now it is believed that there is no real difference between a straight slot and the curved slot as shown. But there still is believed to be a big difference with a circular port, which is not desirable.

The slots 51-53 have sill ledge 85 which is the ledge closest to the crease 80. The slots 51-53 have a brow ledge 90 which is spaced rearward of the sill ledge 85. The sill 85 and brow ledge 90 and are joined by the spaced ends which in this case are half-circles.

It has been inventively determined that the effectiveness of the compensator 10 appears to be most closely related to optimizing the angular length of the sill 85 relative to axial length of the knee wall 95. Again, the knee wall 95 is the axial span of the sidewall 40's inner surface 65 between the crease 80 and the sill 85. When the knee wall 95 was too reduced, the gun barrel 14 would rise after a gun shot. But when the sill 85 was brought back too far, the length of the knee wall 95 was too great and it over-compensated, and sent the gun barrel 14 down.

The chambers 31-33 of the compensator 10 reduce progressively in size. The top ports 51-53 (as well as the side ports 41-43) do too. The ports 51-53 and 41-43 get smaller as they progress from the first to the third chamber 31-33.

The choice of three chambers 31, 32 and 33 is not arbitrary but again a result of proto-typing, testing, and re-designing.

When a prototype was tested with one chamber (31), it was not very effective. When another prototype was tested with two chambers (31-32), it was more effective and the change was very apparent. When a prototype was tested with three chambers (31-33 as shown), it was more effective still, but with just noticeable difference ("JND," 'just noticeable difference,' is a concept borrowed from medicine meaning a small/smallest detectable difference in the performance of a base reference structure relative to a changed—albeit putatively enhanced—structure, according to sensory criteria). Then when a prototype was tested with four chambers (not shown), there was no noticeable difference.

The result that three is sufficient is somewhat analogous to (barely somewhat analogous to) the classroom illustration of the "sum" operator for exponentials of fractions. That is, the sum of one to infinity of the fraction to one-half to the power of n is sometimes taught in a classroom as crossing a unit distance (eg., between two walls) in successive iterations.

With every iteration, the pupil steps off half way to the far wall. So with the first iteration, the student goes half-way to the far wall. In the second iteration, the student steps off half of the half that's left and is now at the three-fourths mark. After the third iteration, the student is at the seven-eights mark, and so on. There comes a point where further iterations only provide futilely small gains, and that comes on early in the process. So it is here too.

The top ports 51-53 do, without any contribution from the side ports 41-43, contribute to recoil compensation. It turns out that, how much so is very noticeable relative to different locations and sizes of the top ports 51-53. The tops ports 51-53 can be sized and arranged to provide 100% recoil compensation needed, but then the top ports 51-53 would be too effective for climb arresting. Making the knee walls 95 of the top ports 51-53 too substantial in connection with the sills 85 of the top ports 51-53 being too wide (and an otherwise proportionately sized opening so that the brow 90 is not causing restriction) only sends the gun barrel 14 down.

Hence the inventor hereof proceeded to introducing the side ports 41-43. Through his testing, he did not like the results provided by round holes, nor D-shaped apertures either. He arrived at the side ports 41-43 having a quadrilateral shape with rounded corners. The ledge for the side ports 41-43 nearest the crease 80 of the associated chamber 31-33 is the sill 84 for any side port 41-43, and wherein the axially rearward spaced ledge is the brow 90 and the angularly spaced ledges are the ends.

In consequence, the inventor hereof optimized the top ports 51-53 for climb arresting, in isolation of the contribution of the side ports 41-43. The side ports 41-43 are then introduced and optimized for recoil compensation, except not in isolation but in combination with the top ports 51-53.

The results are shown by the drawings. FIGS. 1 through 8 are drawn to scale. It will be noticed the knee-wall axial length 95 and sill angular length 85 for each top port 51, 52 or 53 exceeds the same 94 and 84 for the pair of opposite side ports 41, 42 or 43 in the same chamber 31, 32 or 33 respectively. Chamber length of chambers 31-33 gets progressively shorter from the first chamber 31 to the third chamber 33. Hence chamber volume for chambers 31-33 gets progressively smaller from the first chamber 31 to the third chamber 33 as well.

Correspondingly, for each of the top ports 51-53, the sill 85 and knee wall 95 dimensions therefor get progressively smaller from first the chamber 31 to the third chamber 33. Same with the side ports 41-43, that sill 84 and knee wall 94 dimensions get progressively smaller from the first chamber 31 to the third chamber. However, in each chamber 31, 32 or 33; the sill 85 and knee wall 95 lengths for the top port 51, 52 or 53 always exceed the sill 84 and knee wall 94 lengths for the respective side ports 41, 42 or 43.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A recoil compensator and climb arrester (10) secured to the muzzle end (16) of a gun barrel (14), comprising:

an axially-elongated hollow casing (18) extending between a rear end formed with muzzle-engaging formations (12) and a front end (73), said casing (18) further having a sidewall (40) having an inner surface (65) defining an interior duct, said sidewall (40) further having a radially spaced top and bottom as well as a pair of radially spaced sides;

a plurality of baffles (61-63) having central apertures and fixed inside the duct longitudinally spaced apart from one another to partition the duct into a plurality of longitudinally-distributed gas-expansion chambers (31-33);

wherein the plurality of baffles (61-63) are aligned such that the central apertures thereof define a central bore which is coaxial with the bore of the gun barrel (14);

each baffle (61-63) having a convex rear surface (81-83) for deflection of gases, each convex rear surface (81-83) meeting the sidewall's (40) inner surface (65) in an endless crease (80);

the sidewall (40) being formed with at least three ports (41,51; 42,52~43,53) per expansion chamber (31-33) for exhaust of gases, and comprising at least one top port (51-53) in the top of the sidewall (40) as well as a pair of opposite side ports (41-40) in the spaced sides of the sidewall (40);

each port (41-43,51-53) being angularly elongated in the sidewall (40) between angularly spaced closed-ends spacing an axially-spaced sill (84-85) and brow (90);

the sidewall (40) being defined with at least three knee-wall portions (94-95) per chamber (31-33), each knee-wall portion (94-95) being defined on the side wall (40) as axially extending between the sill (84,85) of the respective port (41-43,51-53) and the axially forward crease (80);

whereby the expansion of the gases of a muzzle blast in the expansion chambers (31-33) deflect in part off convex rear surfaces (81-83) of the baffles (61-63) and get checked in part by the knee-wall portions (94-95) of each port (41-43,51-53) ensuing the exhausting of the gases through ports (41-43,51-53) across the sills (84-85) thereof;

wherein the plurality of chambers (31-33) progress from the rear end (~12) of the casing (18) to the front end (73) between a first chamber (31) and a last chamber (33);

correspondingly, for each of the top ports (51-53), the sill (85) and knee wall (95) angular and axial lengths, respectively, get progressively smaller from first chamber (31) to the last chamber (33).

2. The recoil compensator and climb arrester (10) of claim 1 wherein:

each port (41-43, 51-53) comprises an angularly-elongated sill (84-85);

each port (41-43, 51-53) is characterized by an angular length for the sill (84-85) thereof as well as an axial length for the knee wall (94-95) thereof;

in each chamber (31-33), the sill (85) and knee wall (95) angular and axial lengths respectively for the top port (51-53) always exceed the sill (84) and knee wall (94) lengths for the respective side ports (41-43).

3. The recoil compensator and climb arrester (10) of claim 1 wherein:

the plurality of chambers (31-33) progress from the rear end (~12) of the casing (18) to the front end (73) between a first chamber (31) and a last chamber (33);

correspondingly, the plurality of baffles (61-63) progress from a first baffle (61) to a last baffle(63) wherein the longitudinal spacing therebetween gets progressively smaller from the first baffle (61) to the last baffle(63) such that each of the chambers (31-33) has a characteristic chamber length that gets progressively shorter from the first chamber (31) to the last chamber (33);

whereby each of the chambers (31-33) has a characteristic chamber volume that gets progressively smaller from the first chamber (31) to the third chamber (33).

4. A recoil compensator and climb arrester (10) secured to the muzzle end (16) of a gun barrel (14), comprising:

an axially-elongated hollow casing (18) extending between a rear end formed with muzzle-engaging formations (12) and a front end (73), said casing (18) further having a sidewall (40) having an inner surface (65) defining an interior duct, said sidewall (40) further having a radially spaced top and bottom as well as a pair of radially spaced sides;

a plurality of baffles (61-63) having central apertures and fixed inside the duct longitudinally spaced apart from one another to partition the duct into a plurality of longitudinally-distributed gas-expansion chambers (31-33);

wherein the plurality of baffles (61-63) are aligned such that the central apertures thereof define a central bore which is coaxial with the bore of the gun barrel (14);

each baffle (61-63) having a convex rear surface (81-83) for deflection of gases, each convex rear surface (81-83) meeting the sidewall (40)'s inner surface (65) in an endless crease (80);

the sidewall (40) being formed with at least one top port (51-53) in the top of the sidewall (40) per expansion chamber (31-33) for exhaust of gases;

each port (51-53) being angularly elongated in the sidewall (40) between angularly spaced closed-ends spacing an axially-spaced sill (85) and brow (90);

the sidewall (40) being defined with at least one knee-wall portion (95) per chamber (31-33), said knee-wall portion (95) being defined on the side wall (40) as axially-extending between the sill (85) of the respective port (51-53) and the axially forward crease (80);

whereby the expansion of the gases of a muzzle blast in the expansion chambers (31-33) deflect in part off convex rear surfaces (81-83) of the baffles (61-63) and get checked in part by the knee-wall portions (95) of each port (51-53) ensuing the exhausting of the gases through ports (51-53) across the sills (85) thereof;

wherein the plurality of chambers (31-33) progress from the rear end (~12) of the casing (18) to the front end (73) between a first chamber (31) and a last chamber (33);

correspondingly, for each of the top ports (51-53), the sill (85) and knee wall (95) angular and axial lengths, respectively, get progressively smaller from first chamber (31) to the last chamber (33).

5. The recoil compensator and climb arrester (10) of claim 4 wherein:

the plurality of chambers (31-33) progress from the rear end (~12) of the casing (18) to the front end (73) between a first chamber (31) and a last chamber (33);

correspondingly, the plurality of baffles (61-63) progress from a first baffle (61) to a last baffle(63) wherein the longitudinal spacing therebetween gets progressively smaller from the first baffle (61) to the last baffle(63) such that each of the chambers (31-33) has a characteristic chamber length that gets progressively shorter from the first chamber (31) to the last chamber (33);

whereby each of the chambers (31-33) has a characteristic chamber volume that gets progressively smaller from the first chamber (31) to the third chamber (33).

6. A recoil compensator (10) secured to the muzzle end (16) of a gun barrel (14), comprising:

an axially-elongated hollow casing (18) extending between a rear end formed with muzzle-engaging formations (12) arid a front end (73), said casing (18) further having a sidewall (40) having an inner surface (65) defining an interior duct, said sidewall (40) further having a radially spaced top and bottom as well as a pair of radially spaced sides;

a plurality of baffles (61-63) having central apertures and fixed inside the duct longitudinally spaced apart from one another to partition the duct into a plurality of longitudinally-distributed gas-expansion chambers (31-33);

wherein the plurality of baffles (61-63) are aligned such that the central apertures thereof define a central bore which is coaxial with the bore of the gun barrel (14);

each baffle (61-63) having a convex rear surface (81-83) for deflection of gases, each convex rear surface (81-83) meeting the sidewall's (40) inner surface (65) in an endless crease (80);

the sidewall (40) being formed with at least a pair of opposite side ports (41-40) per expansion chamber (31-33) for exhaust of gases, one side port (41-40) in each side of the sidewall (40) per expansion chamber (31-33);

each port (41-43) being angularly elongated in the sidewall (40) between angularly spaced closed-ends spacing an axially-spaced sill (84-85) and brow (90);

the sidewall (40) being defined with at least a pair of knee-wall portions (94) per chamber (31-33), each knee-wall portion (94) being defined on the side wall (40) as axially extending between the sill (84) of the respective port (41-43) and the axially forward crease (80);

whereby the expansion of the gases of a muzzle blast in the expansion chambers (31-33) deflect in part off convex rear surfaces (81-83) of the baffles (61-63) and get checked in part by the knee-wall portions (94) of each port (41-43) ensuing the exhausting of the gases through ports (41-43) across the sills (84) thereof;

wherein the plurality of chambers (31-33) progress from the rear end (−12) of the casing (18) to the front end (73) between a first chamber (31) and a last chamber (33);

correspondingly, for each of the side ports (41-43), the sill (84) and knee wall (94) angular and axial lengths, respectively, get progressively smaller from first chamber (31) to the last chamber (33).

7. The recoil compensator (10) of claim 6 wherein:

the plurality of chambers (31-33) progress from the rear end (~12) of the casing (18) to the front end (73) between a first chamber (31) and a last chamber (33);

correspondingly, the plurality of baffles (61-63) progress from a first baffle (61) to a last baffle(63) wherein the longitudinal spacing therebetween gets progressively smaller from the first baffle (61) to the last baffle(63) such that each of the chambers (31-33) has a characteristic chamber length that gets progressively shorter from the first chamber (31) to the last chamber (33);

whereby each of the chambers (31-33) has a characteristic chamber volume that gets progressively smaller from the first chamber (31) to the third chamber (33).

* * * * *